US005404084A

United States Patent [19]

Onodera et al.

[11] Patent Number: 5,404,084

[45] Date of Patent: Apr. 4, 1995

[54] METHOD OF AND APPARATUS FOR CANCELING ELECTRIC FIELD

[75] Inventors: Toshio Onodera; Kazuaki Hoshino, both of Kanagawa, Japan

[73] Assignee: Sony Corporation, Tokyo, Japan

[21] Appl. No.: 174,411

[22] Filed: Dec. 28, 1993

[30] Foreign Application Priority Data

Mar. 31, 1993 [JP] Japan ..... 5-097277

[51] Int. Cl.[6] ..... H01J 29/56

[52] U.S. Cl. ..... 315/370; 315/8; 315/85; 361/150

[58] Field of Search ..... 315/370, 8, 85; 361/150

[56] References Cited

U.S. PATENT DOCUMENTS 5,151,635 9/1992 Cappels ..... 315/370
5,231,332 7/1993 Beaumont et al. ..... 315/85
5,243,262 9/1993 Moen ..... 315/370
5,260,626 11/1993 Takase et al. ..... 315/85
5,311,099 5/1994 Grocki ..... 315/8

*Primary Examiner*—Theodore M. Blum
*Attorney, Agent, or Firm*—Jay H. Maioli

[57] ABSTRACT

An electric field cancellation apparatus that can reduce electric field radiation from a cathode ray tube inexpensively includes a canceling pulse generating circuit generating a pulse voltage that cancels a leaked electric field radiated from a high voltage generating circuit employed with a deflection circuit or the like. The canceling pulse voltage is superimposed upon an output voltage of the high voltage generating circuit and is applied through an anode to an aperture grill of the cathode ray tube, whereby an electric field having a phase opposite to that of the leaked electric field is radiated from the whole surface of the aperture grill, so that the leaked electric field radiated from the cathode ray tube can be canceled.

16 Claims, 3 Drawing Sheets

METHOD OF AND APPARATUS FOR CANCELING ELECTRIC FIELD

BACKGROUND OF THE INVENTION

1. Field of the Invention

The present invention generally relates to an electric field cancellation apparatus for a cathode ray tube (CRT) display and, more particularly, to an electric field cancellation apparatus for a CRT display that can be produced inexpensively.

2. Description of the Background

Heretofore, CRT displays have become very popular as an integral part of computer terminals. Concurrently therewith, the electromagnetic waves of a low frequency, that is, the so-called ELF, VLF radiation, leaked from the CRT display have become a controversial problem from a health standpoint. Several attempts have been made in order to reduce this electromagnetic wave leakage because of this possible health problem.

A main source generating this kind of electromagnetic wave is considered to be the deflection yoke and the flyback transformer within the CRT display, as well any other circuit parts using a high voltage and a large current, such as the power transformer or the like. Electromagnetic waves generated from these circuit parts contain both magnetic field radiation and electric field radiation. It has been already proposed to reduce the magnetic radiation by decreasing the leakage in each of the circuit parts or by using a canceling device for canceling the magnetic field radiation. It is known that the electric field radiation is removed when the whole of the apparatus is shielded, however, a display screen or face of the CRT display cannot be covered with a metal plate and still be useful. Therefore, some other method must be employed in order to reduce the leaked electric field radiation.

Conventional methods employ a transparent conductive film, for example, an ITO film, having high conductivity bonded to the surface of the CRT screen, a pulse voltage of opposite polarity is applied through a metal plate or antenna lead provided within a bezel or frame to increase the shielding effect of the aperture grill or of the shadow mask by connecting a capacitor having a large capacitance between the anode of the CRT and ground.

According to any of these conventional methods, the structure of the CRT display must be modified in some special fashion. That is, as described above, the transparent conductive film must be bonded onto the surface of the CRT, the metal plate or antenna lead must be laid over within the bezel or the capacitor having large capacitance must be connected between the anode of the CRT and ground. Thus, according to these proposed arrangements if the electric field radiation is reduced sufficiently then the CRT display becomes complicated and expensive.

U.S. Pat. No. 5,151,635 also describes an electric field cancellation apparatus for a CRT display.

OBJECTS AND SUMMARY OF THE INVENTION

Therefore, it is an object of the present invention to provide an electric field cancellation apparatus for a CRT display in which the above-noted shortcomings and disadvantages encountered with the previously proposed systems can be eliminated.

More specifically, it is an object of the present invention to provide an electric field cancellation apparatus for a CRT display in which electric field radiation can be reduced in an uncomplicated, inexpensive fashion.

It is another object of the present invention to provide an electric field cancellation apparatus for a CRT display in which a sufficient electric field cancellation effect can be obtained regardless of the size of the picture screen of the CRT display.

According to a first aspect of the present invention there is provided an electric field cancellation apparatus for a cathode ray tube for displaying an image that includes a deflection yoke for deflecting an electron beam in the cathode ray tube, a deflection circuit for supplying a deflection signal to the deflection yoke, a high voltage generating circuit for generating a high voltage signal fed to the cathode ray tube, and a canceling pulse generating circuit for generating a pulse for canceling an electric field emission.

In accordance with a second aspect of the present invention, there is provided an electric field canceling method for a CRT display which comprises the steps of generating a canceling signal from a high voltage signal, supplying the canceling signal to a cathode ray tube through a capacitor, and emitting an inverse electric field from a part of the cathode ray tube.

In accordance with a third aspect of the present invention, there is provided an electric field canceling method for a CRT display that comprises the steps of generating a canceling signal from a horizontal deflection signal, supplying the canceling signal to a cathode ray tube through a capacitor, and emitting an inverse electric field from a part of the cathode ray tube.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF PREFERRED EMBODIMENTS

Figure 1:
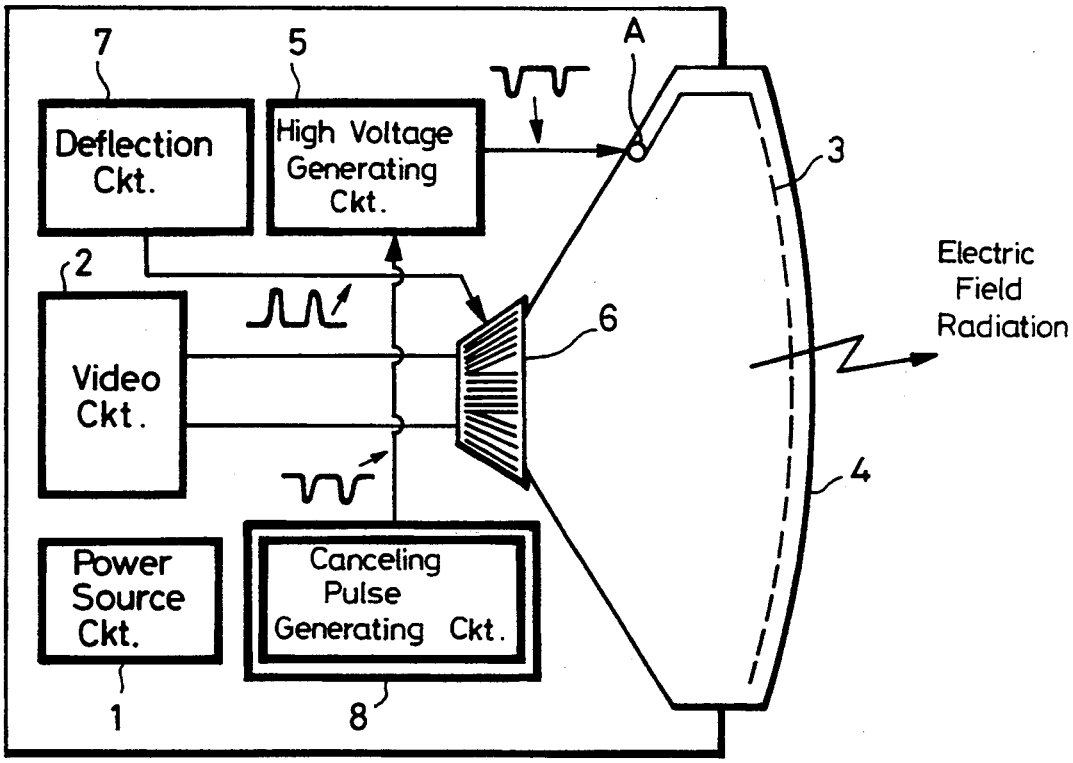
FIG. 1 is a schematic in block diagram form showing an overall system of a CRT display according to the present invention.

FIG. 1 of the accompanying drawings shows a block diagram of an overall system of a CRT display according to the present invention, in which a power source circuit 1 supplies power to respective portions within the CRT display. A video signal from a video circuit 2 is radiated as an electron beam on a CRT screen 4 through an aperture grill known as a shadow mask 3. The aperture grill 3 is supplied with a high voltage from a high-voltage generating circuit 5 through an anode A of the CRT. A deflection current from a deflection circuit 7 flows in a deflection yoke (DY) 6 to thereby deflect the electron beam that passes within the CRT, so that the beam scans the screen 4. A canceling pulse generating circuit 8 generates a pulse voltage to cancel a leaked electric field radiated from the high voltage generating circuit 5, from the deflection circuit 7, or from other circuit elements. The canceling pulse voltage is superimposed upon the output voltage from the high voltage generating circuit 5 and then supplied to the aperture grill 3 through the anode A, whereby an electric field having a phase opposite to that of the leaked electric field is radiated from the whole surface of the aperture grill 3. The leaked electric field radiated from each of the parts provided within the CRT display is then canceled by this electric field radiation.

Figure 2:
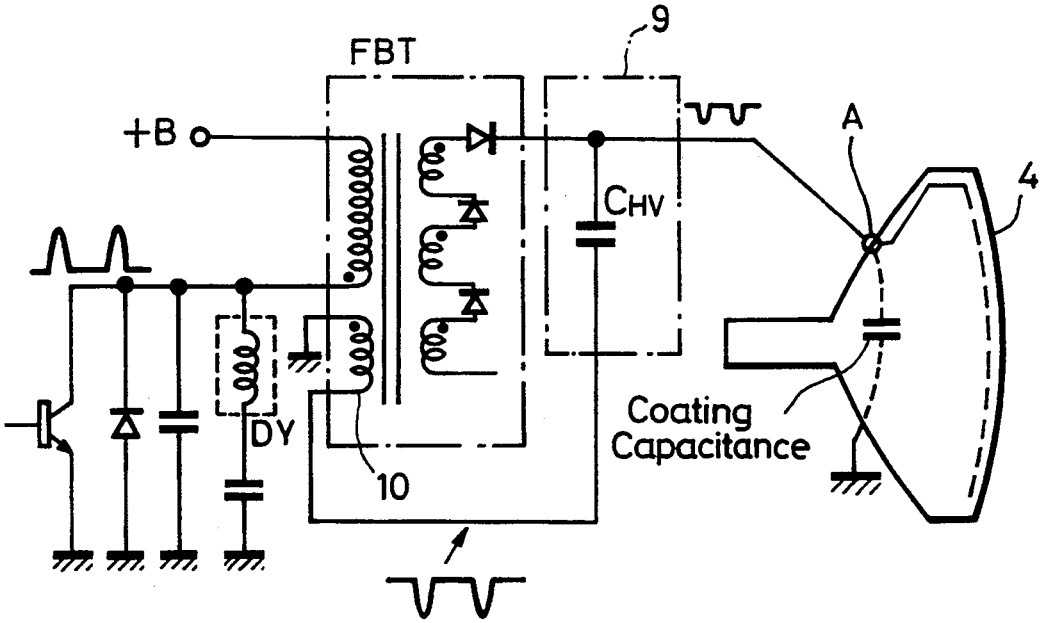
FIG. 2 is a circuit diagram of an electric field cancellation apparatus according to a first embodiment of the present invention.

FIG. 2 is a circuit diagram of the electric field cancellation apparatus for a CRT display according to a first embodiment of the present invention, in which the canceling pulse generating circuit 8 is formed of a winding 10 provided in the flyback transformer FBT of the high voltage generating circuit 5 of FIG. 1. A leaked electric field canceling pulse obtained in this winding 10 is superimposed upon an output high voltage generated from the flyback transformer FBT through a superimposing circuit 9. The superimposing circuit 9 is formed of a high voltage capacitor $C_{HV}$ as shown in FIG. 2.

In FIG. 2, the reason that the leaked electric field canceling pulse is obtained from the winding 10 formed as part of the flyback transformer FBT is that the largest leaked electric field component of the leaked electric field components that becomes a problem is a flyback pulse generated from the horizontal output circuit of the cathode ray tube display system.

Figure 3:
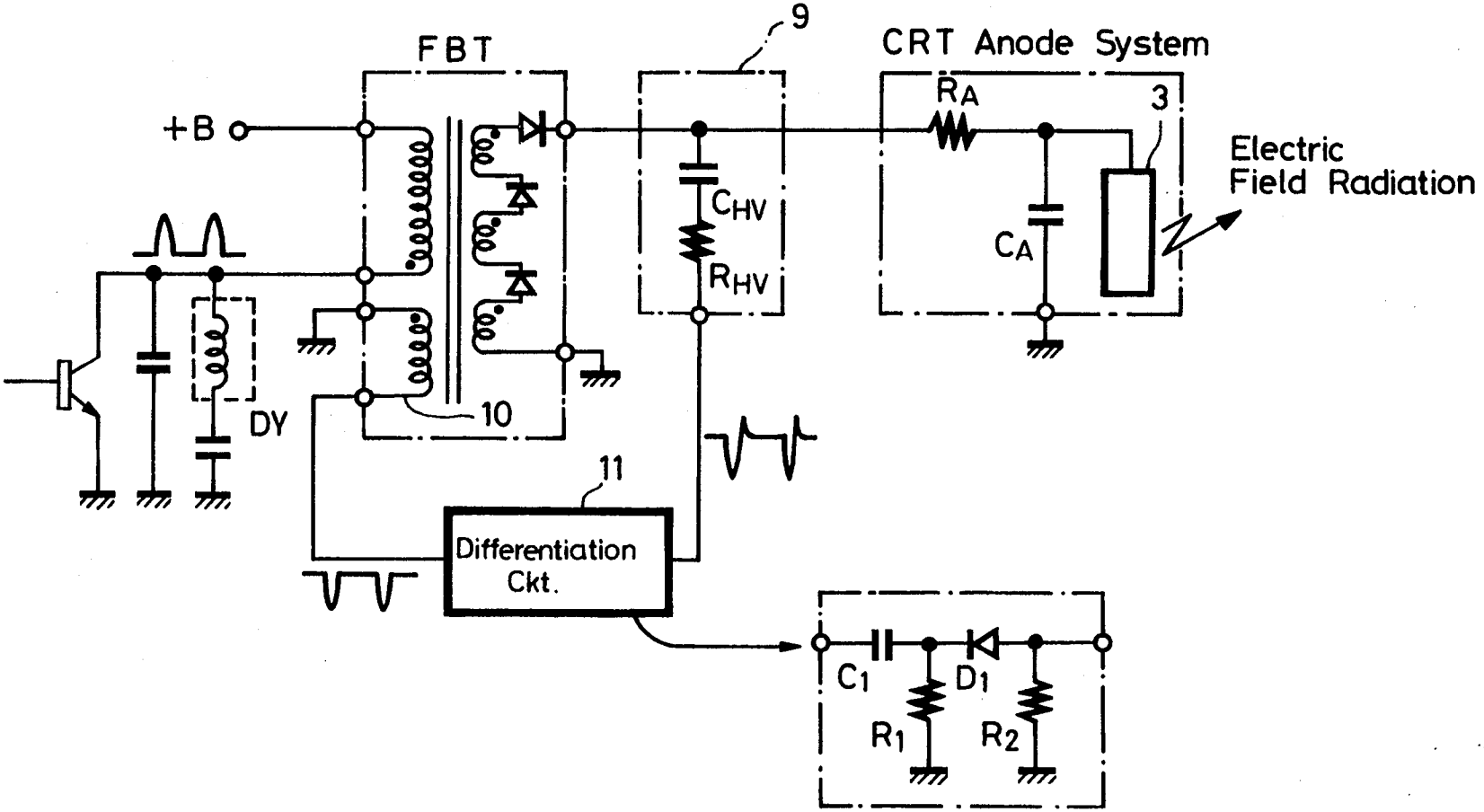
FIG. 3 is a circuit diagram of an electric field cancellation apparatus according to a second embodiment of the present invention.

FIG. 3 is a circuit diagram of the leaked electric field cancellation apparatus for a CRT display according to a second embodiment of the present invention, in which a differentiation circuit 11 is interposed between the winding 10 provided in the flyback transformer FBT and the superimposing circuit 9. The differentiation circuit 11 is comprised of a series connected capacitor $C_1$ and diode D1 and ground resistors $R_1$, $R_2$ connected to both ends of the diode D1 and to ground, respectively.

The reason that the electric field cancellation apparatus includes the differentiation circuit 11 as shown in FIG. 3 will be described below.

As shown in FIG. 3, the anode system of the CRT can be equivalently expressed by a capacitance $C_A$ formed by an internally-coated carbon film and a resistor $R_A$. Also, it is customary that a resistor $R_{HV}$ is connected to the high voltage capacitor $C_{HV}$ in series in order to protect from high-voltage discharge.

With the above-described arrangement, the capacitance $C_A$ the resistor $R_A$, the high voltage capacitor $C_{HV}$ and the resistor $R_{HV}$ constitute a filter. Therefore, it is frequently observed that a waveform of the canceling pulse is blunted or a phase thereof is delayed depending upon the frequency. For this reason, the differentiation circuit 11 is additionally provided in order to adequately cancel an attenuation characteristic of the above-mentioned filter. That is, by using this differentiation circuit 11 the magnitude and phase of the canceling pulse voltage transmitted to the aperture grill 3 can be optimally adjusted, so that the leaked electric field canceling effect can be achieved at a maximum.

Figure 4:
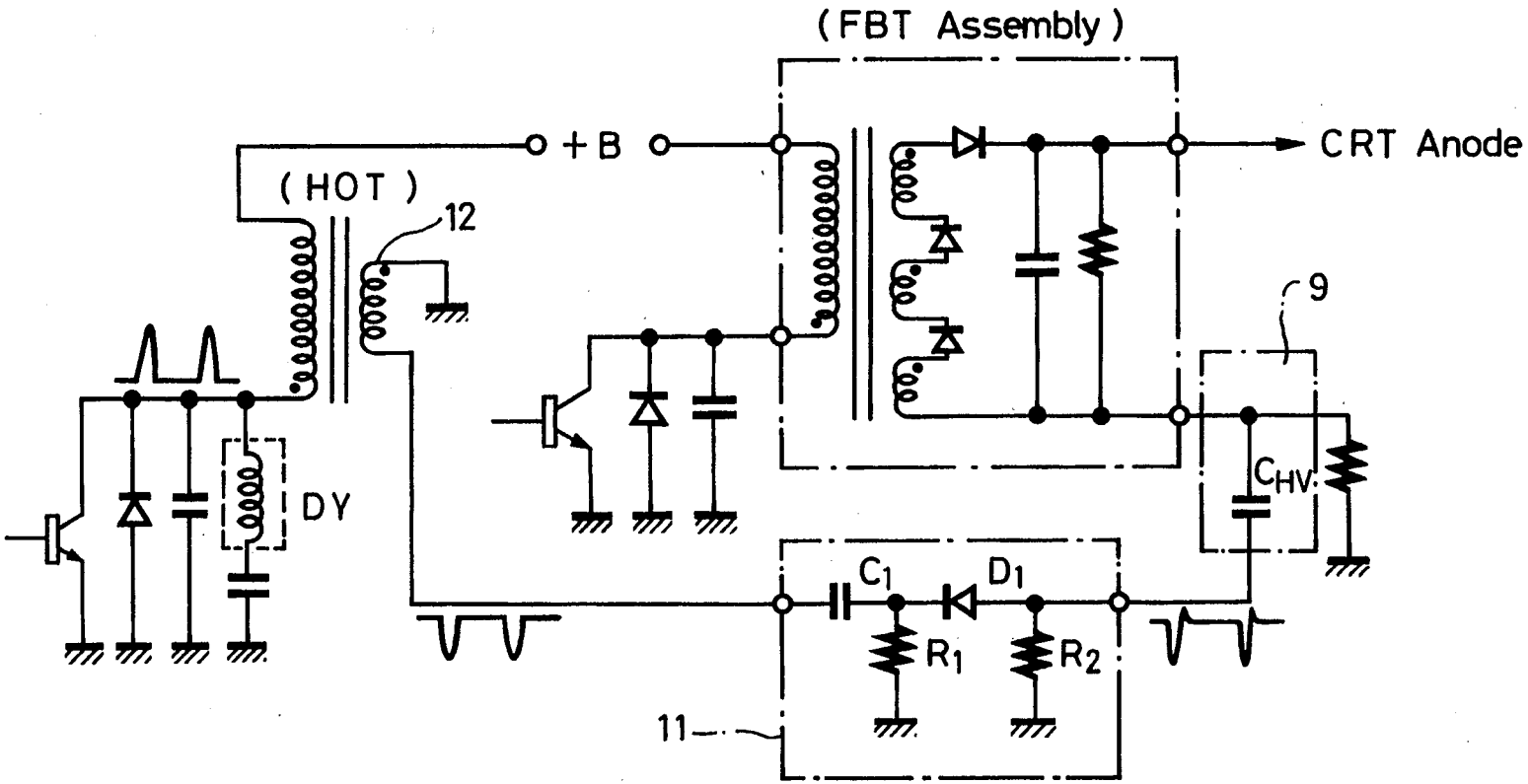
FIG. 4 is a circuit diagram of an electric field cancellation apparatus according to a third embodiment of the present invention.

FIG. 4 is a circuit diagram of the leaked electric field cancellation apparatus for a CRT display according to a third embodiment of the present invention, in which the canceling pulse generating circuit 8 is provided as a secondary winding 12 of the horizontal output transformer (HOT). A canceling pulse voltage generated from the secondary winding 12 is supplied through the differentiation circuit 11 to the superimposing circuit 9, in which it is superimposed upon the output signal from the flyback transformer FBT assembly. This circuit arrangement shown in FIG. 4 is particularly suitable for use with a high resolution display that has an individualized deflection system, for example, having a horizontal frequency $f_H$=79 kHz.

According to the present invention, it is possible to provide a leaked electric field cancellation apparatus for a CRT display in which electric field radiation can be reduced easily and inexpensively compared with conventional methods.

Furthermore, because the canceling electric field is radiated from the whole surface of the aperture grill by applying the canceling pulse voltage to the anode of the CRT, a very large leaked electric field canceling effect can be achieved.

In addition, unlike the defects encountered with the prior art such that the leaked electric field reducing effect becomes weak as the size of a picture screen becomes large or that a cost of the material is increased, according to the present invention a sufficient electric field canceling effect can be obtained by a substantially constant circuit arrangement regardless of the size of the picture screen.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electric field cancellation apparatus for a cathode ray tube display comprising:

a deflection yoke for deflecting an electron beam in said cathode ray tube in response to a pulsed deflection signal;

a deflection circuit for supplying said deflection signal to said deflection yoke;

a high voltage generating circuit for generating a high voltage signal fed to said cathode ray tube;

a canceling pulse generating circuit for generating canceling pulses having a polarity opposite to a polarity of pulses of said pulsed deflection signal and superimposed on said high voltage signals for cancelling an electric field emission; and means for supplying said canceling pulse superimposed on said high voltage signal to an anode of said cathode ray tube, wherein said canceling pulse supplied to said anode of said cathode ray tube is connected to an aperture grill of said cathode ray tube.

2. An electric field cancellation apparatus for a cathode ray tube display comprising:

a deflection yoke for deflecting an electron beam in said cathode ray tube in response to a pulsed deflection signal;

a deflection circuit for supplying said deflection signal to said deflection yoke;

a high voltage generating circuit for generating a high voltage signal fed to said cathode ray tube;

a canceling pulse generating circuit for generating canceling pulses having a polarity opposite to a polarity of pulses of said pulsed deflection signal and superimposed on said high voltage signals for cancelling an electric field emission; and means for supplying said canceling pulse superimposed on said high voltage signal to an anode of said cathode ray tube, wherein said canceling pulse supplied to said anode of said cathode ray tube is connected to a shadow mask of said cathode ray tube.

3. An electric field cancellation apparatus for a cathode ray tube display as claimed in claim 1, wherein said canceling pulse generating circuit comprises a winding of a flyback transformer.

4. An electric field cancellation apparatus for a cathode ray tube display as claimed in claim 1, further comprising capacitor means whereby said canceling pulse is supplied to said cathode ray tube.

5. An electric field cancellation apparatus for a cathode ray tube display comprising:

a deflection yoke for deflecting an electron beam in said cathode ray tube in response to a pulsed deflection signal;

a deflection circuit for supplying said deflection signal to said deflection yoke;

a high voltage generating circuit for generating a high voltage signal fed to said cathode ray tube;

a canceling pulse generating circuit for generating canceling pulses having a polarity opposite to a polarity of pulses of said pulsed deflection signal and superimposed on said high voltage signal for cancelling an electric field emission;

means for superimposing said canceling pulse on said high voltage signal; tube;

capacitor means for supplying said cancelling pulse superimposed on said high voltage signal to an anode of said cathode ray tube; and a differential circuit whereby said canceling pulse is differentiated and supplied to said capacitor means.

6. An electric field cancellation apparatus for a cathode ray tube display as claimed in claim 5, wherein said differential circuit comprises a differential capacitor, a diode connected in series to said differential capacitor and first and second resistors connected respectively between both ends of said diode and ground.

7. An electric field cancellation apparatus for a cathode ray tube display as claimed in claim 1, wherein said canceling pulse generating circuit includes a horizontal deflection signal generator.

8. An electric field cancellation apparatus for a cathode ray tube display as claimed in claim 7, wherein said canceling pulse is derived from a secondary winding of a horizontal output transformer of said horizontal deflection signal generator.

9. An electric field cancellation apparatus for a cathode ray tube display as claimed in claim 7, further comprising capacitor means whereby said canceling pulse is supplied to said cathode ray tube.

10. An electric field cancellation apparatus for a cathode ray tube display comprising:

a deflection yoke for deflecting an electron beam in said cathode ray tube in response to a pulsed deflection signal;

a deflection circuit for supplying said deflection signal to said deflection yoke;

a high voltage generating circuit for generating a high voltage signal fed to said cathode ray tube;

a canceling pulse generating circuit for generating canceling pulses having a polarity opposite to a polarity of pulses of said pulsed deflection signal and superimposed on said high voltage signals for cancelling an electric field emission, wherein said canceling pulse generating circuit includes a horizontal deflection signal generator;

capacitor means, whereby said canceling pulse is supplied to said cathode ray tube; and a differential circuit whereby said canceling pulse is differentiated and supplied to said capacitor means.

11. An electric field cancellation apparatus for a cathode ray tube display as claimed in claim 10, wherein said differential circuit comprises a differential capacitor, a diode connected in series with said differential capacitor, and first and second resistors connected respectively between both ends of said diode and ground.

12. An electric field cancellation apparatus for a cathode ray tube display as claimed in claim 9, wherein said canceling pulse through said capacitor means is supplied to said cathode ray tube at an output of a flyback transformer.

13. A method of canceling a leaked electric field for a cathode ray tube display comprising the steps of:

generating a canceling signal from a high voltage signal;

supplying said canceling signal to a cathode ray tube through a capacitor;

emitting an electric field inverse to the unwanted electric field from a part of said cathode ray tube; and differentially processing said canceling signal before supplying said canceling signal to said cathode ray tube through said capacitor.

14. A method of cancelling an unwanted electric field for a cathode ray tube display as claimed in claim 13, comprising the further step of inverting a phase of said emitting electric field relative to a phase of the leaked electric field.

15. A method of canceling a leaked electric field for a cathode ray tube display comprising the steps of:

generating a canceling signal from a horizontal deflection signal;

supplying said canceling signal to the cathode ray tube through a capacitor;

emitting an electric field inverse to the unwanted electric field from a part of said cathode ray tube; and differentially processing said canceling signal before supplying said canceling signal to said cathode ray tube through said capacitor.

16. A method of canceling a leaked electric field for a cathode ray tube display as claimed in claim 15, comprising the further step of inverting a phase of said emitting electric field relative to a phase of the leaked electric field.

* * * * *